US007765723B2

(12) United States Patent
Chagnot et al.

(10) Patent No.: US 7,765,723 B2
(45) Date of Patent: Aug. 3, 2010

(54) CUTTER HEAD FOR AN EXCAVATOR MACHINE

(75) Inventors: Philippe Chagnot, Nanterre (FR); Jean-Claude Riglet, Nanterre (FR)

(73) Assignee: Compagnie du Sol, Nanterre (FR)

( * ) Notice: Subject to any disclaimer, the term of this patent is extended or adjusted under 35 U.S.C. 154(b) by 0 days.

(21) Appl. No.: 11/826,418

(22) Filed: Jul. 16, 2007

(65) Prior Publication Data

US 2008/0022563 A1 Jan. 31, 2008

(30) Foreign Application Priority Data

Jul. 28, 2006 (FR) ..... 06 53169

(51) Int. Cl.
*E02F 5/08* (2006.01)

(52) U.S. Cl. ..... 37/94; 37/189; 37/91; 37/902; 299/39.4

(58) Field of Classification Search ..... 37/94, 37/364, 365, 189, 462, 902
See application file for complete search history.

(56) References Cited

U.S. PATENT DOCUMENTS

| | | | | | |
|---|---|---|---|---|---|
| 3,932,992 | A * | 1/1976 | Martin | 60/431 |
| 4,047,763 | A * | 9/1977 | Gilliland et al. | 299/76 |
| 4,098,539 | A * | 7/1978 | Zitz et al. | 299/75 |
| 4,785,559 | A * | 11/1988 | Hentschel | 37/94 |
| 4,800,967 | A * | 1/1989 | Chagnot et al. | 175/96 |
| 4,844,549 | A * | 7/1989 | Steff de Verninac | 175/91 |
| 4,883,134 | A * | 11/1989 | Bollinger et al. | 175/96 |
| 5,158,126 | A * | 10/1992 | Lang | 144/375 |
| 5,186,094 | A * | 2/1993 | Allart | 91/491 |
| 5,975,644 | A * | 11/1999 | Lang | 299/39.4 |
| 6,186,046 | B1 * | 2/2001 | Allart et al. | 91/491 |
| 6,199,377 | B1 * | 3/2001 | Allart et al. | 60/439 |
| 6,270,163 | B1 * | 8/2001 | Mullet et al. | 299/75 |
| 6,318,235 | B1 * | 11/2001 | Allart et al. | 91/491 |
| 6,626,500 | B1 * | 9/2003 | Cribb et al. | 299/78 |
| 2004/0256908 | A1 * | 12/2004 | Risi | 299/78 |

FOREIGN PATENT DOCUMENTS

| | | |
|---|---|---|
| DE | 20 37 317 A1 | 2/1972 |
| DE | 22 11 280 B1 | 4/1973 |
| DE | 195 39 249 A1 | 4/1996 |
| FR | 2 438 778 A1 | 5/1980 |

* cited by examiner

*Primary Examiner*—Thomas A Beach
*Assistant Examiner*—Matthew R Buck
(74) *Attorney, Agent, or Firm*—Kenyon & Kenyon LLP

(57) ABSTRACT

The invention relates to a cutter head for an excavator machine including at least one cutter motor, each cutter motor comprising:

a fastener plate;

a mounting structure secured to the fastener plate and presenting a central portion and two mounting assemblies disposed on either side of the fastener plate;

two hydraulic motors mounted in said mounting assemblies;

a shaft common to both hydraulic motors;

a plurality of conduits formed in the thickness of said fastener plate for passing the flow of the liquid used by the hydraulic motors; and a plurality of ducts formed in said central portion of the mounting structure, said ducts being connected to said conduits and to said hydraulic motors to connect each of the two motors to each of said conduits.

10 Claims, 3 Drawing Sheets

CUTTER HEAD FOR AN EXCAVATOR MACHINE

The present invention relates to a cutter head for an excavator machine commonly referred to as a cutter.

BACKGROUND OF THE INVENTION

Cutter type excavator machines are usually used for making trenches in the ground to considerable depth, up to 100 meters (m), and of width that is relatively small compared with said depth, the width typically lying in the range 500 millimeters (mm) to 1500 mm. One of the advantages of such machines is to enable such deep trenches to be made while complying with a requirement for being rigorously vertical. The trench of the hole is obtained by successively digging adjacent panels.

In general, cutters are constituted by a box structure of considerable height that serves to provide mechanical guidance to the excavator machine as the trench is being made. At the bottom end of the box structure there is a cutter head. These machines are themselves well known and it therefore suffices to mention that the cutter head is usually constituted by two cutter motors each usually carrying a pair of drums on which cutter tools are mounted. Each pair of drums rotates about a common axis, with the two axes of the cutter motors being parallel and horizontal in use. The cutter drums are driven in rotation by hydraulic motors.

Various types of mount are possible. In the configuration adopted in particular by the supplier Bauer, the hydraulic motor is placed inside the box structure above the cutter head. It transmits power via a substantially vertical shaft of small diameter that passes within the thickness of the plate that forms the bearing of the cutter motor. The vertical shaft engages a pair of bevel gears that deliver motion to the horizontal shaft. An epicyclic gear system reduces the speed of rotation and increases torque so as to provide the cutter drums with effective drive.

In another configuration, made available in particular by the supplier Casagrande, the hydraulic motors are located in the bottom portion of the box structure of the machine above the cutter head, and power is transmitted to the cutter drum by a transmission chain.

European patent EP 0 262 050 in the name of Soletanche, discloses a method of driving cutter drums in which the single hydraulic motor is mounted inside the cutter drums and is connected thereto by a stage of reduction gearing, or else by direct transmission. The way in which hydraulic power is applied to the motor is not described.

The first two types of excavator machine mentioned above present the major drawback of having hydraulic motors above the cutter head and thus of mounting those motors in a manner that is more complex and more expensive. In particular, it is not possible to change the cutter heads quickly.

Furthermore, the elements of the drive transmission system for the first two types of cutter (gearing, speed reduction, chain) leads to relatively high losses, of the order of 15%, that do not occur in the configuration described in the European patent in the name of Soletanche.

It should be added that depending on the nature of the work and the terrain being excavated, it can be advantageous to be able to vary the parameters relating to speed of rotation and torque for the cutter drums.

OBJECTS AND SUMMARY OF THE INVENTION

An object of the present invention is to provide a cutter head for a cutter type excavator machine that provides better performance in terms of torque and/or speed than prior machines in an available volume that is determined by the diameter of the cutter drums fitted with cutter tools, which is generally about 1.4 m, and by the thickness of the cutter head, which in the particular configuration of the invention, preferably lies in the range 600 mm to 1500 mm.

To achieve this object, according to the invention the cutter head for an excavator machine is constituted by at least one cutter motor that comprises:

- a fastener plate;
- a mounting structure, distinct from the fastener plate, secured to the fastener plate, and presenting a central portion and two mounting assemblies disposed on either side of the midplane of the fastener plate;
- two hydraulic motors, each motor being mounted in one of said mounting assemblies;
- a common shaft for both hydraulic motors substantially perpendicular to the fastener plate;
- a plurality of conduits formed in the thickness of said fastener plate for conveying the liquid used by the hydraulic motors; and
- a plurality of ducts formed in said central portion of the mounting structure, said ducts being connected firstly to said conduits, and secondly to said hydraulic motors for connecting each of the two motors to each of said conduits.

It will be understood that by means of the dispositions of the invention, the set of two cutter drums mounted on a common shaft is driven simultaneously by the two hydraulic motors. This enables greater power to be made available for driving a cutter drum. It should also be understood that the delivery of fluid and the removal of fluid leaving the hydraulic motors is optimized since this flow is obtained firstly by a plurality of conduits formed in the thickness of the fastener plate, and secondly by ducts formed in the central portion of the mounting structure. Thus, the hydraulic motors are accessible at each end of the cutter head and can thus be removed relatively easily.

In addition, because the central portion of the mounting structure is a part that is distinct from the plate, the fastener plate can be of small thickness. Only the conduits need to be formed in the plate and they can be rectilinear. In contrast, the connection ducts leading to the hydraulic motors are formed in the central portion of the mounting structure, i.e. in a location where room is available.

Furthermore, the assembly constituted by the fastener plate and the hydraulic motor mounting structure is sufficiently rigid to accommodate bending deformation forces.

Preferably, the cutter head includes a system for controlling variation in the cylinder capacity of the hydraulic motors under the control of the fluid conveyed in one of said conduits.

Furthermore, and preferably, the ducts formed in the central portion of the mounting structure of the cutter head for feeding said hydraulic motors are made in such a manner that the axial thrust produced by the feed liquid against the faces of the rotors of the motors is substantially balanced.

It will be understood that because of this disposition, the axial thrust due to the operation of the two hydraulic motors is compensated. The axial thrust that needs to be taken up by mechanical systems such as bearings therefore relates only to axial thrust as might be applied to the cutter drum by possible non-uniformity in the ground where cutting is taking place.

Also preferably, the cutter drums are mounted on the two mounting assemblies via bearings that are interposed between the drums or more precisely their rims and the outside faces of the motor assemblies. For the reasons set out above, the bearings do not need to withstand bending forces.

BRIEF DESCRIPTION OF THE DRAWINGS

Other characteristics and advantages of the invention appear better on reading the following description of an embodiment of the invention given by way of non-limiting example. The description refers to the accompanying figures, in which.

MORE DETAILED DESCRIPTION

Figure 1A:
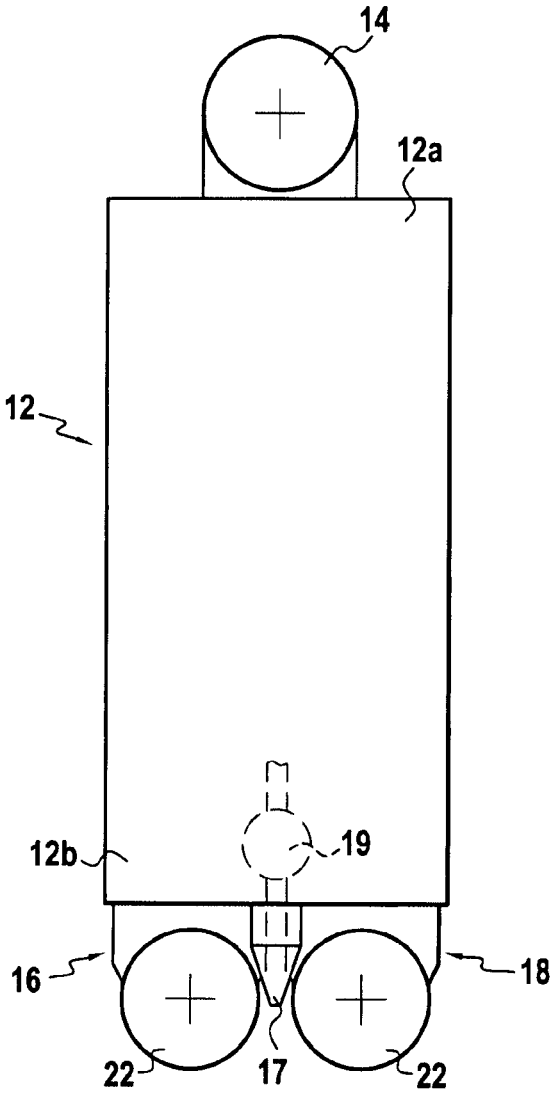
FIGS. 1A and 1B are overall views of an excavator machine of the cutter type shown in elevation view and in side view.
Figure 1B:
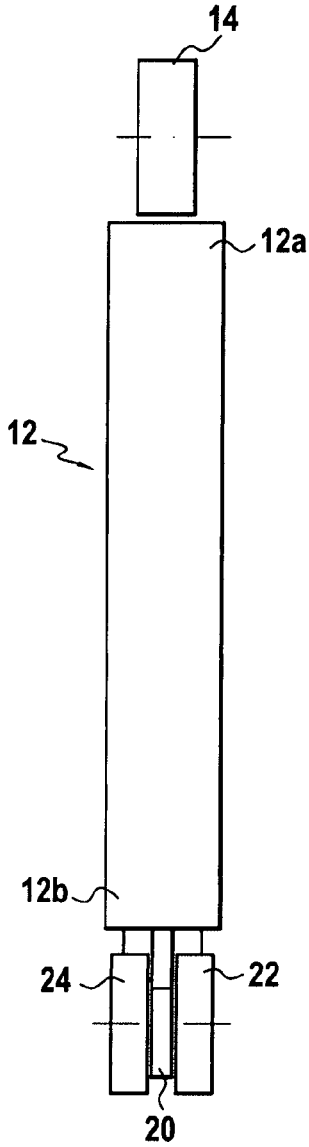

FIGS. 1A and 1B are simplified views showing the overall shape of a cutter type excavator machine. The machine is constituted by a relatively long box structure 12 of horizontal section that is substantially rectangular. The top end 12*a* of the box structure is fitted with pulleys 14 over which tackle passes to support the cutter 12. At the bottom end 12*b* of the box structure 12 there are two identical cutter motors 16 and 18 forming a cutter head. Each cutter motor 16 or 18 is essentially constituted by a fastener plate 20 having mounted thereon two cutter drums 22 and 24 symmetrically about the midplane of the fastener plate 20. The invention relates to applying rotary drive to the cutter drums 22, 24 of the cutter motors 16 and 18.

There are also shown the nozzle 17 for sucking in the ground cuttings, and the pump 19 for applying the suction force.

Figure 2:
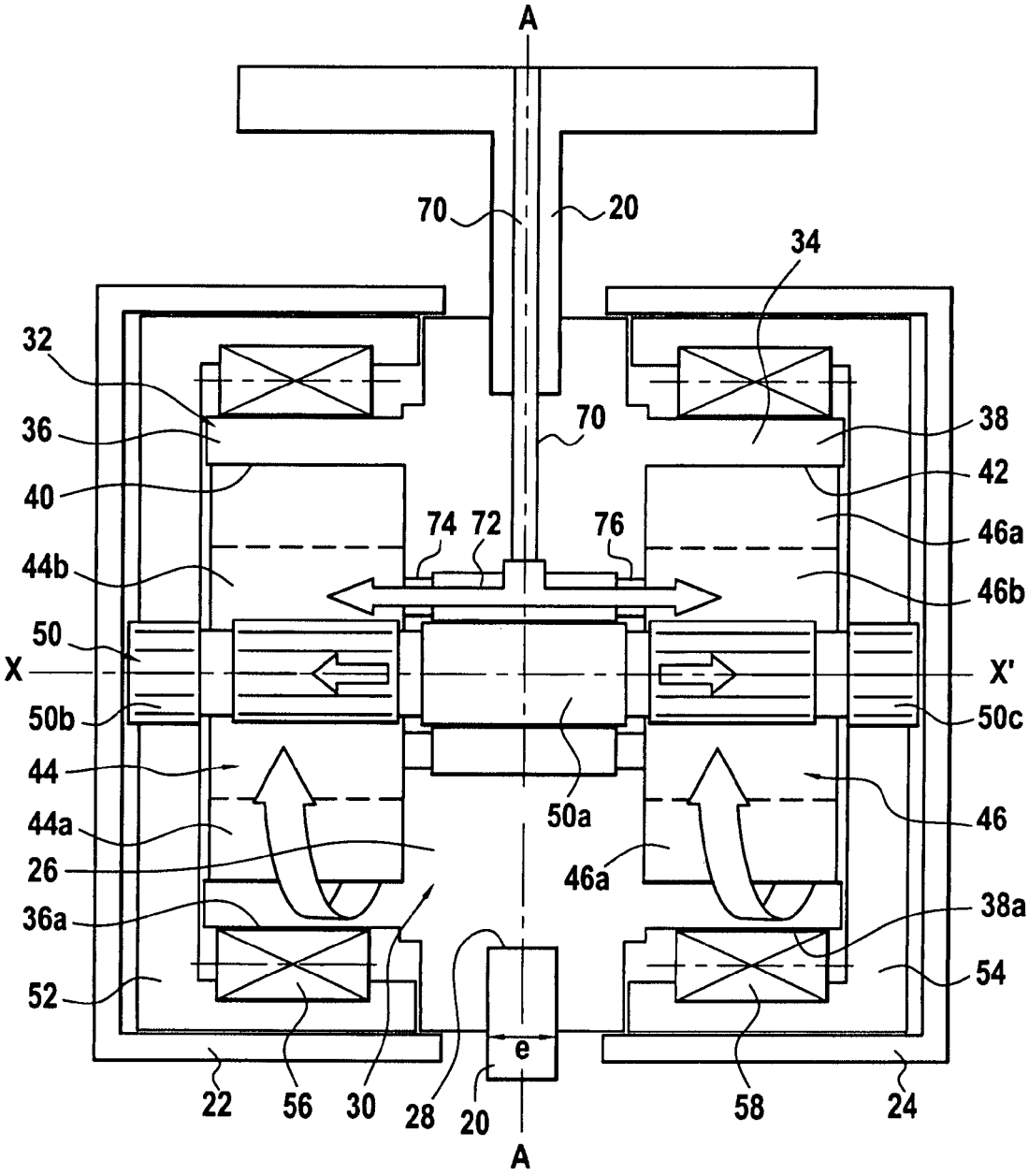
FIG. 2 is a vertical section view of a cutter motor showing its essential elements.

With reference to FIG. 2, there follows a description of the general organization of how a pair of cutter drums 22, 24 constituting a cutter motor are driven in rotation.

The cutter motor 16 comprises a mounting structure 26 that is secured to the fastener plate 20 and that is engaged in a preferably circular opening 28 about an axis XX'. The mounting structure 26 has a central portion 30 that is preferably substantially symmetrical about the midplane of the fastener plate 20, and two mounting assemblies 32 and 34 extending symmetrically preferably on either side of the central portion 30. The central portion is engaged in the orifice 28 of the plate 20. In the particular embodiment shown, the mounting assemblies 32 and 34 are constituted by cylindrical bushings 36 and 38, thereby defining two substantially cylindrical mounting cavities 40 and 42 that are outwardly open. Inside the cavities 40 and 42, which are preferably but not necessarily identical, there are mounted the hydraulic motors 44 and 46. Each hydraulic motor comprises a stator 44*a*, 46*a* and a rotor 44*b*, 46*b*. Each rotor 44*b* and 46*b* is mounted on a common shaft 50 of axis coinciding with the axis XX'. The middle portion 50*a* of the shaft 50 passes through the central portion 30 of the mounting structure via a suitably provided bore. The ends 50*b* and 50*c* of the shaft 50 are secured to drive parts or rims 52 and 54. The cutter drums 22 and 24 are mounted on the rims 52 and 54. The rims 52 and 54 are guided and supported in rotation by bearings 56 and 58 which are themselves mounted on the outside faces 36*a*, 38*a* of the bushings 36 and 38 forming the mounting assemblies of the hydraulic motors. The function of the bearings 56 and 58 is essentially to take up the forces applied by the cutter drums during cutting operations.

The liquids needed for the operation of the hydraulic motors and their environment are caused to flow in the following manner. Conduits such as 70 are drilled in the thickness of the fastener plate 20. Ducts 72 are made in the central portion 30 of the mounting structure. The central portion may be of a thickness that is much greater than that of the plate. The thickness of the central portion may typically be about 400 mm. The conduits are connected at one end to respective fluid feed or exhaust pipes placed in the box structure of the cutter, while their other ends are connected to the ducts shown diagrammatically at 72 in FIG. 2. Since these ducts are straight, the plate 20 may be small in thickness while still having sufficient mechanical strength. Its thickness may be restricted to 60 mm. This is very important since beneath the plate, the cutter drums cannot dig directly into the ground. As explained below in the embodiment under consideration, there are five feed conduits 70 corresponding respectively to the high pressure feed for the hydraulic motors, the low pressure oil return from the hydraulic motors, draining internal leaks from the hydraulic motors, an oil duct delivering balancing pressure to sealing gaskets of the cutter motor to prevent drilling mud from penetrating inside the cutter motors themselves, and a duct that transmits hydraulic pressure for controlling a device that changes the cylinder capacity of the hydraulic motors when the cutter motor is fitted with such a device.

In practice, each hydraulic motor may have two different cylinder capacities in order to adapt to cutting conditions. A change of cylinder capacity is controlled by a hydraulic system mounted in the central portion 30 of the mounting structure.

Pressure balancing systems are themselves well known. There is therefore no need to describe them. It suffices to remember that in the invention the ducts feeding the balancing system is provided in the fastener plate 20.

The ducts such as 72 are formed in the central portion 30 of the mounting structure. These ducts are preferably symmetrical for feeding or recovering liquids in the same manner for both hydraulic motors 44 and 46.

Insofar as the ducts 72 serve to feed rotary portions of the hydraulic motors, these ducts terminate in distributor systems such as 74 and 76, referred to as "faces", that provide a rotary connection between the feed ducts and the hydraulic inlets or outlets of the rotors 44*b* and 46*b*.

It can be understood that insofar as each duct 72 feeds the faces 74 and 76 corresponding to the two hydraulic motors 44 and 46 symmetrically, the pressure exerted by the liquid or oil on the feed faces of the hydraulic motors 44 and 46 are identical and therefore balanced axially. One of the advantages of this configuration is thus avoiding any need to install bearings or abutments to take up axial thrust along the direction of the axis XX' that might would otherwise be due to the feed liquids. However, it would not go beyond the invention if there were no effective compensation of thrusts at the feed faces 74 and 76 of the hydraulic motors, which can be advantageous under certain circumstances.

Figure 3:
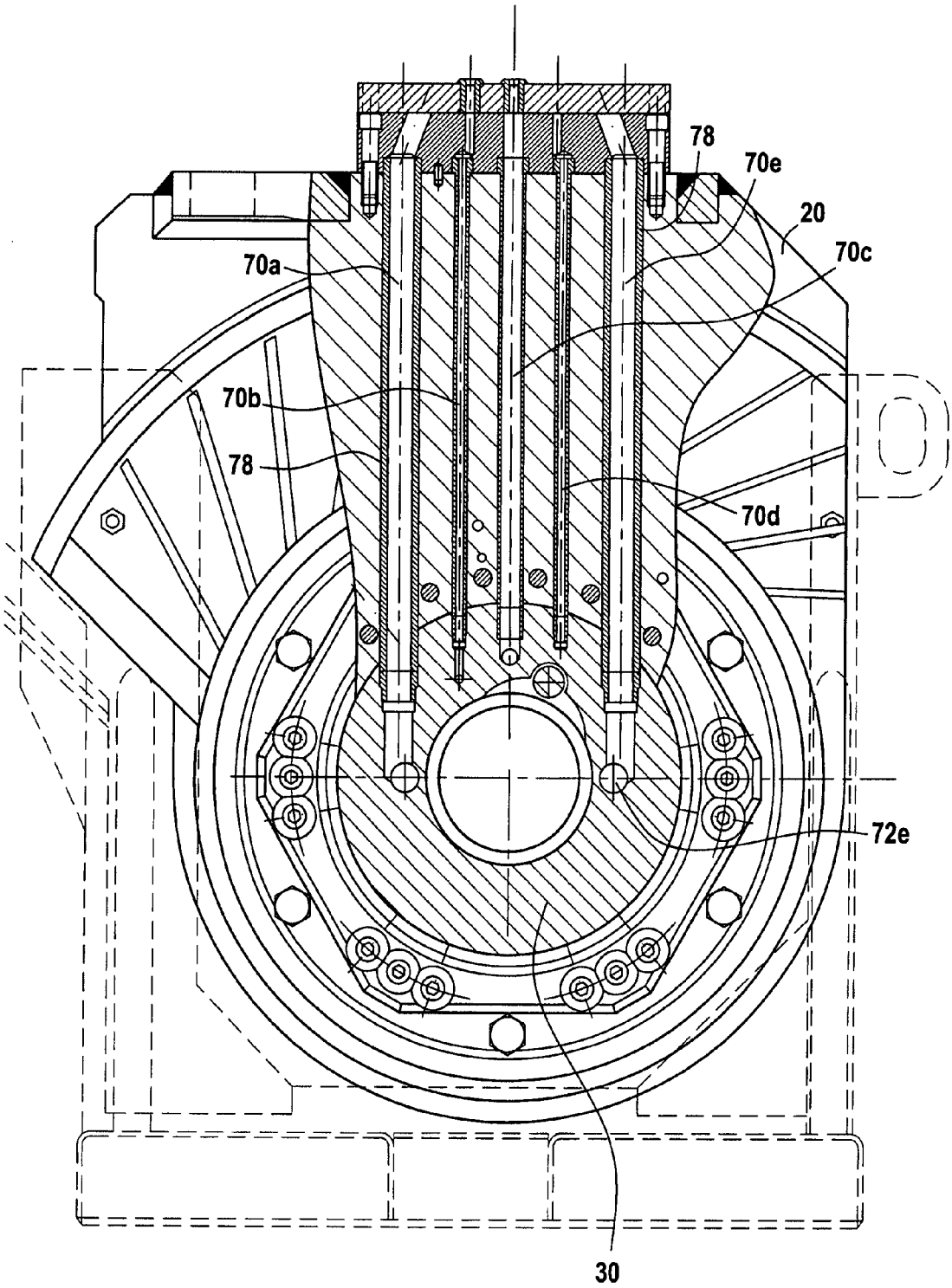
FIG. 3 is a view of a cutter motor in section on line A-A of FIG. 2.

FIG. 3 shows the conduits 70 and the ducts 72 in greater detail. In particular, there can be seen the five feed conduits

70*a* to 70*e* formed in the thickness of the fastener plate 20. As can be seen better in this figure, the conduits 70*a* to 70*e* are preferably lined, with their inside walls being coated in a layer 78 that presents a high degree of fluid-tightness and also good mechanical strength. This lining 76 of the conduits 70*a* to 70*e* serves to provide sealing and integrity for the flows of liquids under pressure, while also co-operating with the linear nature of the conduits 70, as mentioned above, to enable the fastener plate 20 to have a thickness e that is relatively small, e.g. about 60 mm. It will be understood that it is important for this plate to present thickness that is relatively small since this thickness defines the zone in which the cutter drums 22 and 24 do not act. The presence of this fastener plate 20 causes a step to be left between the zones that are actually cut by the cutter drums 22 and 24. This step can sometimes be very difficult to break when the geological stratum is very hard.

The bottom ends of the conduits 70*a* to 70*e* are connected to the ducts 72*a* to 72*e* that extend symmetrically in the central portion 26 of the mounting structure. The ends of the ducts open out in the faces for communicating with the rotary portions of the hydraulic motors. The ducts 72*a* to 72*e* used for feeding high pressure and for exhausting low pressure to and from the hydraulic motors 44 and 46 are situated at the same distance from the axis XX' of the central portion 26.

What is claimed is:

1. A cutter head for an excavator machine having at least one cutter motor, each cutter motor comprising:

a fastener plate presenting an opening;

a mounting structure, distinct from the fastener plate, secured into the opening of the fastener plate, and presenting a central portion, and two mounting assemblies disposed on either side of the midplane of the fastener plate;

two hydraulic motors, each hydraulic motor being mounted in one of said mounting assemblies and each hydraulic motor having two different cylinder capacities;

a common shaft for both hydraulic motors substantially perpendicular to the fastener plate and passing through the central portion;

a plurality of conduits formed in the thickness of said fastener plate for conveying a liquid used by the hydraulic motors;

a plurality of ducts formed in said central portion of the mounting structure, said ducts being connected firstly to said conduits, and secondly to said hydraulic motors for connecting each of the two hydraulic motors to each of said conduits; and a control system for varying the cylinder capacity of the hydraulic motors, wherein one of said conduits formed in the thickness of said fastener plate is used to control said control system, and wherein said control system is mounted in the central portion of the mounting structure.

2. The cutter head according to claim 1, wherein the two hydraulic motors are substantially identical, and wherein they are substantially symmetrical about the midplane the fastener plate.

3. The cutter head according to claim 1, further comprising two rims for mounting cutter drums, each rim being connected to move with one of the ends of said common shaft, and two sets of bearings mounted on the outside faces of said mounting assemblies to guide said drum-carrying rims, at least in rotation.

4. The cutter head according to claim 1, wherein said ducts formed in the central portion of the mounting structure to feed said hydraulic motors are made in such a manner that the axial thrust produced by the feed liquid against the faces of said motors is substantially balanced.

5. The cutter head according to claim 1, wherein each cutter motor further comprises sealing gaskets and a pressure balancing system for said sealing gaskets, and wherein one of the conduits formed in said fastener plate is a feed conduit for the balancing system.

6. The cutter head according to claim 3, wherein each mounting assembly includes a cylindrical bushing with said bearings being mounted on the outside faces thereof, said cylindrical bushing defining a mounting cavity in which one of the hydraulic motors is mounted.

7. The cutter head according to claim 1, wherein the opening, in which the central portion of said mounting structure is mounted, is circular and is coaxial with the common shaft.

8. A cutter head for an excavator machine having at least one cutter motor, each cutter motor comprising:

a fastener plate having a substantially constant thickness;

a mounting structure, distinct from the fastener plate, mounted on the fastener plate, and presenting a central portion having a thickness greater than the fastener plate and two mounting assemblies disposed on either side of the midplane of the fastener plate;

two hydraulic motors, each hydraulic motor being mounted in one of said mounting assemblies;

a common shaft for both hydraulic motors substantially perpendicular to the fastener plate;

a plurality of conduits formed in the thickness of said fastener plate for conveying a liquid used by the hydraulic motors;

a plurality of ducts formed in said central portion of the mounting structure, said ducts being connected firstly to said conduits, and secondly to said hydraulic motors for connecting each of the two hydraulic motors to each of said conduits;

a control system for varying the cylinder capacity of the hydraulic motors, wherein one of said conduits formed in the thickness of said fastener plate is used to control said control system, and wherein said control system is mounted in the central portion of the mounting structure; and wherein said fastener plate includes a circular opening coaxial with the common shaft, wherein the central portion of said mounting structure is mounted in said circular opening, and wherein the common shaft passes through the central portion.

9. The cutter head according to claim 8, wherein the mounting assemblies are constituted by cylindrical bushings defining cylindrical mounting cavities in which the hydraulic motors are mounted.

10. A cutter head for an excavator machine having at least one cutter motor, each cutter motor comprising:

a fastener plate:

a mounting structure, distinct from the fastener plate, secured to the fastener plate, and presenting a central portion and two mounting assemblies disposed on either side of the midplane of the fastener plate;

two hydraulic motors, each hydraulic motor being mounted in one of said mounting assemblies and having a plurality of cylinder capacities;

a device that changes the cylinder capacity of the hydraulic motors;

a pressure balancing system for sealing gaskets of the cutter motor;

a common shaft for both hydraulic motors substantially perpendicular to the fastener plate;

a plurality of conduits formed in the thickness of said fastener plate for conveying a liquid used by the hydraulic motors:

a plurality of ducts formed in said central portion of the mounting structure, said ducts being connected firstly to said conduits, and secondly to said hydraulic motors for connecting each of the two hydraulic motors to each of said conduits;

wherein the conduits formed in the thickness of said fastener plate comprise five feed conduits corresponding respectively to high pressure feed for the hydraulic motors, low pressure oil return from the hydraulic motors, a conduit for draining internal leaks from the hydraulic motors, a feed conduit to control the balancing system, and a conduit to control the device that changes the cylinder capacity of the hydraulic motors.

* * * * *